US011731864B2

(12) United States Patent
Samulski

(10) Patent No.: US 11,731,864 B2
(45) Date of Patent: Aug. 22, 2023

(54) TOWER CRANE

(71) Applicant: LIEBHERR-WERK BIBERACH GMBH, Biberach an der Riss (DE)

(72) Inventor: Jochen Samulski, Neu-Ulm (DE)

(73) Assignee: LIEBHERR-WERK BIBERACH GMBH, Biberach an der Riss (DE)

( * ) Notice: Subject to any disclaimer, the term of this patent is extended or adjusted under 35 U.S.C. 154(b) by 233 days.

(21) Appl. No.: 16/963,926

(22) PCT Filed: Jan. 21, 2019

(86) PCT No.: PCT/EP2019/051389
§ 371 (c)(1),
(2) Date: Jan. 4, 2021

(87) PCT Pub. No.: WO2019/145260
PCT Pub. Date: Aug. 1, 2019

(65) Prior Publication Data

US 2021/0114849 A1 Apr. 22, 2021

(30) Foreign Application Priority Data

Jan. 25, 2018 (DE) ..... 10 2018 101 705.7

(51) Int. Cl.

| | |
|---|---|
| ***B66C 23/62*** | (2006.01) |
| ***B66C 23/02*** | (2006.01) |
| ***B66C 23/64*** | (2006.01) |
| ***B66C 23/74*** | (2006.01) |

(52) U.S. Cl.
CPC ..... *B66C 23/62* (2013.01); *B66C 23/02* (2013.01); *B66C 23/64* (2013.01); *B66C 23/74* (2013.01)

(58) Field of Classification Search
CPC ..... B66C 23/62; B66C 23/02; B66C 23/64; B66C 23/74; B66C 2700/0385
See application file for complete search history.

(56) References Cited

U.S. PATENT DOCUMENTS

| | | | | |
|---|---|---|---|---|
| 4,491,229 A * | 1/1985 | Behrendt | ..... | B66C 23/702 212/347 |
| 4,529,094 A * | 7/1985 | Wadsworth | ..... | B66C 23/26 212/255 |
| 7,878,346 B1 * | 2/2011 | Watts | ..... | B66C 23/702 212/300 |

FOREIGN PATENT DOCUMENTS

| | | |
|---|---|---|
| CN | 201850084 U | 6/2011 |
| CN | 103171978 A | 6/2013 |
| CN | 203545532 U | 4/2014 |
| DE | 60020275 T2 | 5/2006 |

(Continued)

*Primary Examiner* — Sang K Kim
*Assistant Examiner* — Nathaniel L Adams
(74) *Attorney, Agent, or Firm* — Dilworth & Barrese, LLP

(57) ABSTRACT

The invention relates to a tower crane, preferably a rotary tower crane, particularly preferably a top-slewing crane, comprising a jib and a counter-jib. The jib and/or counter-jib is hinged to the tower top and/or rotating platform by means of at least one connection point. A first connection part of the at least one connection point has a concave stop surface, and a second connection part of the connection point comprises a convex counter-stop surface, wherein the counter-stop surface of the second connection part acts on the stop surface of the first connection part by means of a pressure force in order to produce a force-fitting connection between the connection parts.

16 Claims, 7 Drawing Sheets

(56) References Cited

FOREIGN PATENT DOCUMENTS

| | | | | | |
|---|---|---|---|---|---|
| FR | 1377553 A | * | 9/1963 | ..... | B66C 9/14 |
| RU | 2225346 C2 | | 3/2004 | | |

* cited by examiner

TOWER CRANE

BACKGROUND OF THE INVENTION

The invention relates to a revolving tower crane, in particular to a top slewer, having a boom and a counterboom, wherein the boom or counterboom is connected in an articulated manner to the tower tip and/or slewing platform by means of at least one connection point.

Booms or counterbooms of a revolving tower crane, in particular of a top slewing tower crane, are typically connected in an articulated manner to the tower tip or to a slewing platform that may be present in the region of the tower tip by a force fit connection. Such connections should be articulated and should be able to be established without tools as much as possible for assembly purposes. As a rule, the connection is made by a plurality of separate connection points.

SUMMARY OF THE INVENTION

Connection points are known whose connection partners are latched together by means of a latch, for example a pin or a metal butt strap with a pin. The connection point is then articulated about a horizontal transverse axis, i.e. the latch axis. Since the force fit between the connection partners is provided by means of the latch and since the greater portion of the forces is thus introduced into the latch, the latter has to have comparatively large or thick dimensions. It can have a weight of approximately 18 kg with medium-sized cranes.

An additional securing of the connection point, in particular of the boom or counterboom, takes place by means of steel securing ropes that should in particular take over a capturing function during the setting up procedure.

It is a disadvantage of the previous design that there is no visibility of the movement of the boom or counterboom during dismantling before the final release of the connection, i.e. during the removal of the latch. The dismantling takes place by means of an auxiliary crane that receives the boom/counterboom. If it does not grip the boom/counterboom exactly at its center of gravity, the boom/counterboom can unpredictably swing away from the connection point after the release of the latch connection. In the worst case, the component can strike against the crane structure in an uncontrolled manner when swinging back and can cause substantial damage to the crane.

It is the object of the present invention to improve the connection of the boom and counterboom at the crane tower.

This object is achieved by a tower crane having the features herein. Advantageous embodiments of the tower crane are the subject of the description herein.

Starting from a tower crane, in particular a revolving tower crane, ideally a top slewer, it is proposed in accordance with the invention to improve the at least one connection point between the boom or counterboom and the tower tip such that a force transmission is implemented via suitable abutment surfaces of the connection parts of the connection point. These abutment surfaces are pressed against one another by an applied compressive force in crane operation so that a force fit is provided between the boom/counterboom and the tower tip.

To provide an articulated connection, a first connection part is provided that has a concave abutment surface. A second, complementary connection part of the connection point in contrast has a convex counter-abutment surface. The design of the abutment surfaces ensure a certain relative movement of the connected crane parts with respect to one another and thus provides the desired articulation of the connection. A relative movement of the boom/counterboom with respect to the crane tower about a horizontal axis oriented transversely to the longitudinal boom axis is thus preferably made possible. Ideally, the negative radius of curvature of the concave abutment surface is matched to the positive radius of curvature of the convex counter-abutment surface.

Unlike in the prior art, a force transmission of the force fit connection should now no longer take place by means of a separate component such as a pin, but rather instead via suitable abutment surfaces of the individual connection parts. The resulting connection point can therefore be constructed considerably more simply and more effectively.

The connection between the boom and the tower tip or between the counterboom and the tower tip and/or slewing platform is preferably implemented by means of a plurality of connection points. For example, corresponding connection parts are provided at the respective end faces of the corner bars of a lattice boom. The complementary connection points are located in the region of the tower tip and can, for example, be provided at a corresponding connection element of the crane tower or also at a slewing platform installed in the region of the tower tip.

The required compressive force that results in a pressing together of the respective connection parts is produced, for example, by the respective boom guying of the counterboom or boom that pulls the boom or counterboom in the direction of the tower tip. In the same way, any load torque of the boom or counterboom likewise results in a corresponding compressive force.

In accordance with a preferred embodiment of the invention, the second connection part can be designed in the form of a connection head, with the connection head being defined as a counter-abutment surface by a defined radius. For example, the connection head can be a head piece projecting from the boom or counterboom, in particular the corner bar, at the end face that provides the corresponding radius at its end facing the tower tip. The connection head in particular forms at least a semicircle or semi-cylinder, with the center axis of the cylinder extending in the horizontal direction.

The first connection piece is accordingly designed as a complementary connection socket to receive the connection head. It is in particular advantageous if the connection socket is configured by an adapted inner radius that corresponds to the radius of the connection head or is dimensioned as slightly larger. The inner wall of the connection socket forms the matching abutment surface of the first connection part.

Provision can optionally be made that at least one connection pin is inserted or insertable to secure the connection point. In this respect, a horizontally aligned pin has proved advantageous that is inserted or insertable through corresponding pin slots of the first and/or second connection parts. Tensile forces in the horizontal direction (boom direction) can be taken up by the corresponding connection pin. Since the pressure compressive force ratio or tensile force ratio in the region of the connection point comes at the considerable cost of the compressive forces removed by means of the abutment surfaces, the connection pin can be dimensioned as comparatively small. A force ratio between compressive forces and tensile forces of approximately 10:1 is ideally present here.

It is particularly advantageous if the pin slot or the connection pin is disposed at the center of the convex counter-abutment surface, i.e. at the center of the formed radius of the connection head, which provides advantages with respect to the pivot movement of the boom or counterboom.

A further advantage of the connection point is the possibility of a tool-free establishing and/or release of the connection. The boom part/counterboom part to be assembled/dismantled is typically taken up by means of an auxiliary crane and is moved into or away from the connection region.

The crane operator of the auxiliary crane has to guide the abutment surfaces of the connection point together during the assembly process. It can be helpful if the moved boom part/counterboom part is captured after the rough alignment. This is preferably effected by means of one or more capturing elements in the region of the moved boom part/counterboom part.

In an advantageous embodiment, at least one capturing element is implemented as a capturing eye that is provided above the abutment surface or counter-abutment surface at the second connection part or at the boom or counterboom in the assembly or operating position. The capturing eye is in principle characterized by an aperture through which a corresponding capturing means of the first connection part or of the tower tip can be inserted, preferably in the horizontal direction.

The capturing eye is sensibly dimensioned larger than the periphery or diameter of the capturing means used. The boom or counterboom can now be roughly moved in the region of the tower tip during the assembly procedure and the capturing means can be inserted through the capturing eye to ensure a rough alignment of the two components toward one another.

However, the capturing element, in particular the capturing eye, also has a substantial function during the dismantling process. After the release of the actual connection point, the connection between the boom or counterboom and the tower tip is still roughly secured by the capturing means inserted through the capturing eye so that a pivoting away of the boom or counterboom is prevented. The possibility thereby arises of first aligning the boom part or counterboom part taken up by the auxiliary crane in a position of equilibrium so that the capturing means is freely suspended within the capturing eye. An uncontrolled pivoting away of the boom or counterboom is hereby also prevented after the removal of the capturing means.

It is particularly preferred if the capturing eye is formed by an aperture within a metal sheet that is perpendicular on the connection head. The metal sheet extends, for example, upwardly from the connection head in the vertical direction. Alternatively, the connection head and the capturing eye can also be made in one piece.

To further simplify the assembly process, it is advantageous if one or more capturing metal sheets are provided in the region of the concave abutment surface, i.e. in the region of the connection socket, that simplify the bringing together of the abutment surfaces, in particular the introduction of the connection head.

In addition to the revolving tower crane in accordance with the invention, the present invention also relates to a method for assembling a boom or counterboom on a tower crane in accordance with the present invention. The method in accordance with the invention is characterized by the following individual method steps:

Moving the boom or counterboom, preferably by means of an auxiliary crane, into the region of the tower tip and capturing the boom or counterboom by inserting the capturing means through the capturing eye. Finely adjusting the boom or counterboom and bringing together the convex counter-abutment surface having the concave abutment surface. Inserting the pin through the second connection part for the pressing of the abutment surfaces onto one another by tensioning the boom guying. Alternatively or additionally, the load torque that in turn effects the compressive force required in the abutment can be produced by lowering the boom.

Finally, the present invention likewise relates to a dismantling method for the release of the connection between the boom or counterboom and the tower crane, with the latter being configured in accordance with the present invention. The dismantling method in accordance with the invention is characterized in that the pin inserted through the second connection part is first drawn in a first step. The connection point is in this case only secured by the connection between the capturing means and the capturing eye. In the following step, the boom or counterboom is aligned such that the capturing means is freely suspended within the capturing eye. Once this state is achieved, it is ensured that a corresponding lifting device, for example, an auxiliary crane, for taking up the boom or counterboom engages it at the center of gravity so that an uncontrolled pivoting away of the boom or counterboom is prevented. The capturing means can then subsequently be removed and the boom or counterboom can be completely dismantled. The possibly present guying of the boom/counterboom has to be let out before the release of the connection pin inserted through the second connection part.

BRIEF DESCRIPTION OF THE DRAWINGS

Further advantages and properties of the invention will be explained in more detail in the following with reference to an embodiment shown in the drawings.

There are shown.

DESCRIPTION OF THE PREFERRED EMBODIMENTS

Figure 1A:
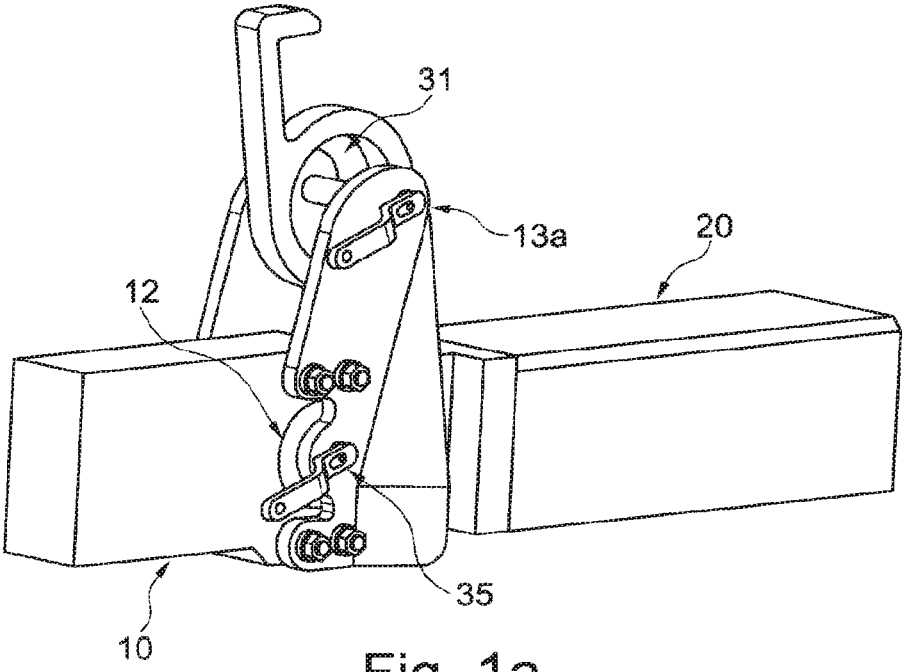
FIG. 1: perspective side views of a connection point in accordance with the invention between the boom or counterboom and the tower crane.
Figure 1B:
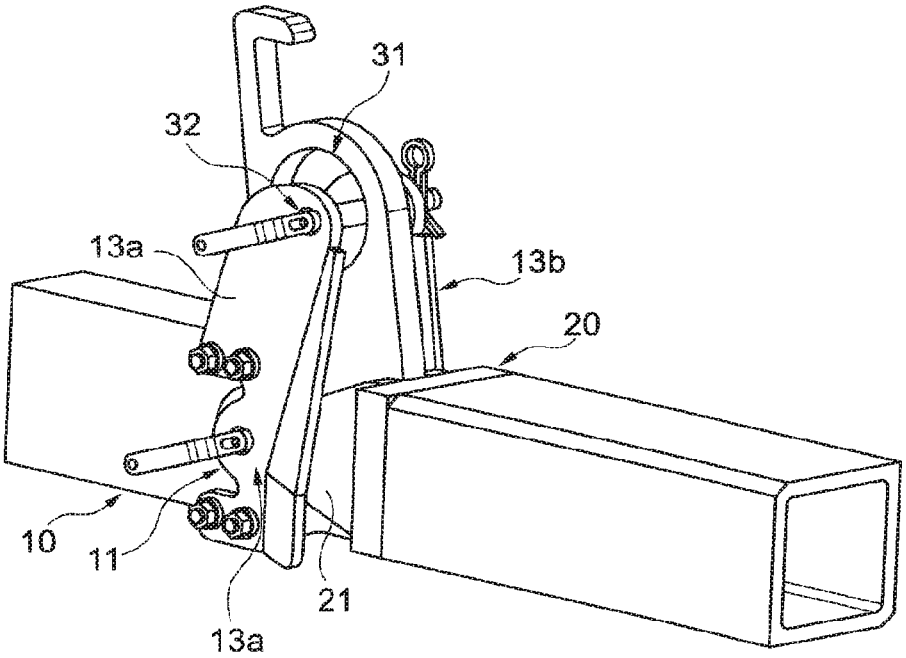
Figure 2:
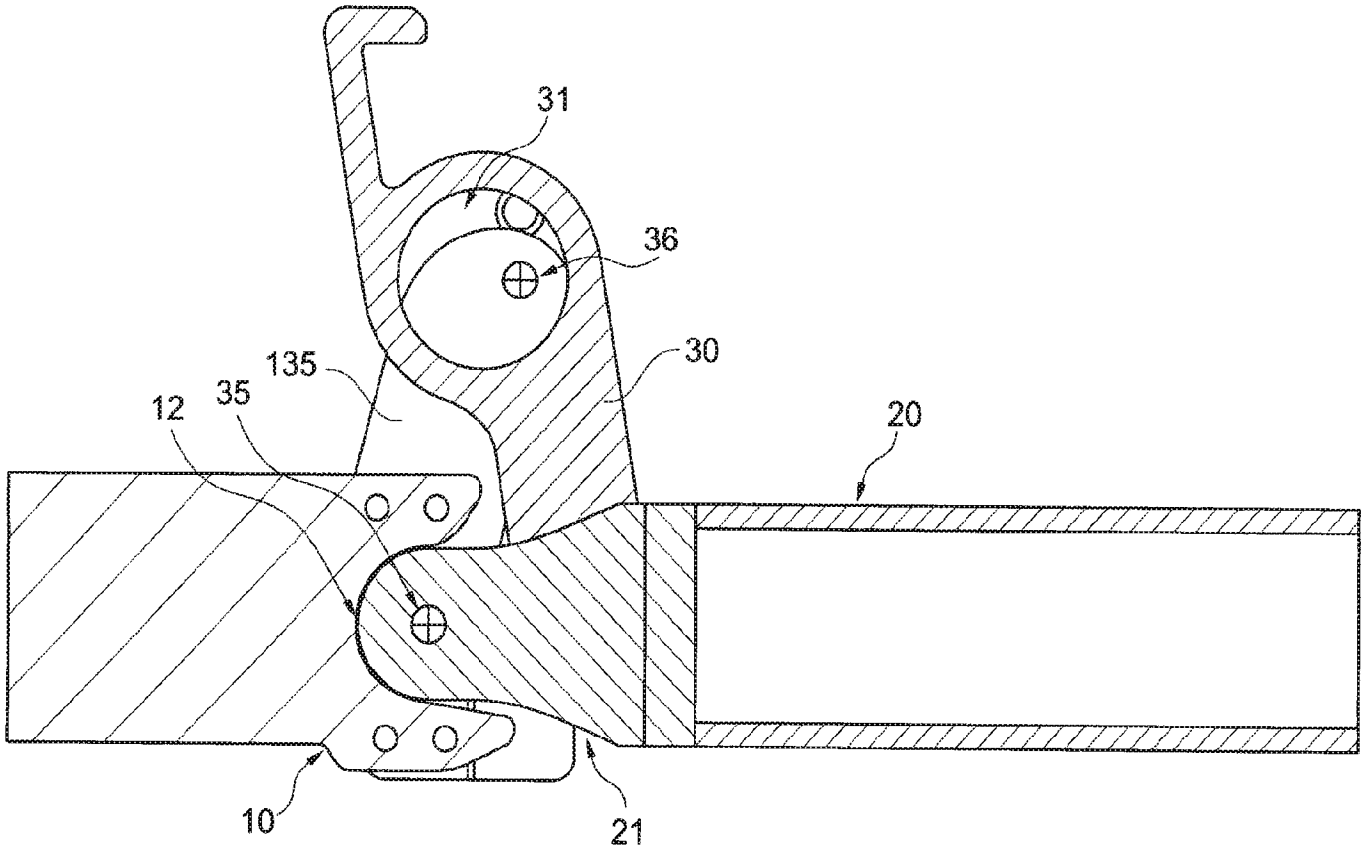
FIG. 2: a sectional representation through the connection point in accordance with the invention.
Figure 3B:
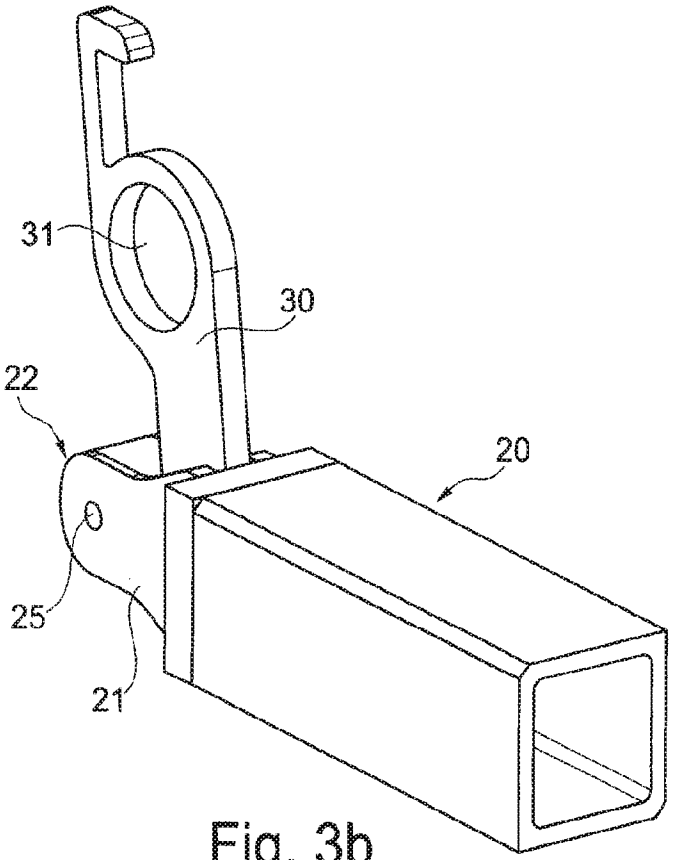
FIG. 3: perspective side views of the second connection part provided at the boom or counterboom.
Figure 3A:
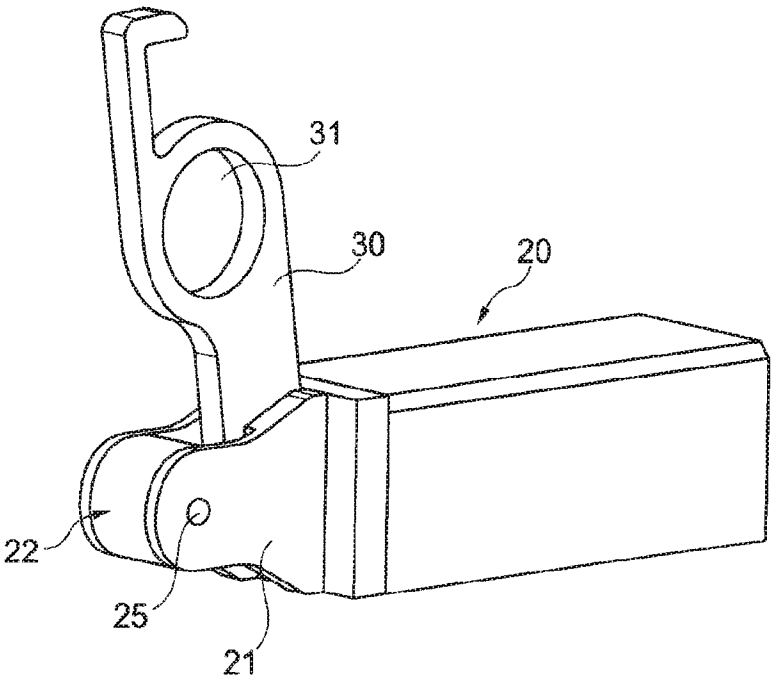
Figure 4B:
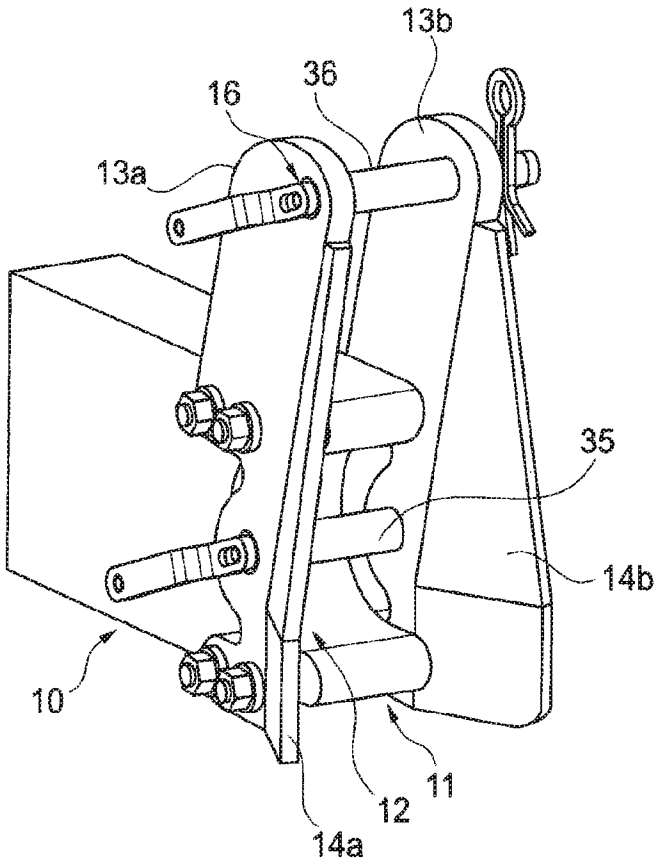
FIG. 4: perspective representations of the first connection part arranged at the tower tip or slewing platform.
Figure 4A:
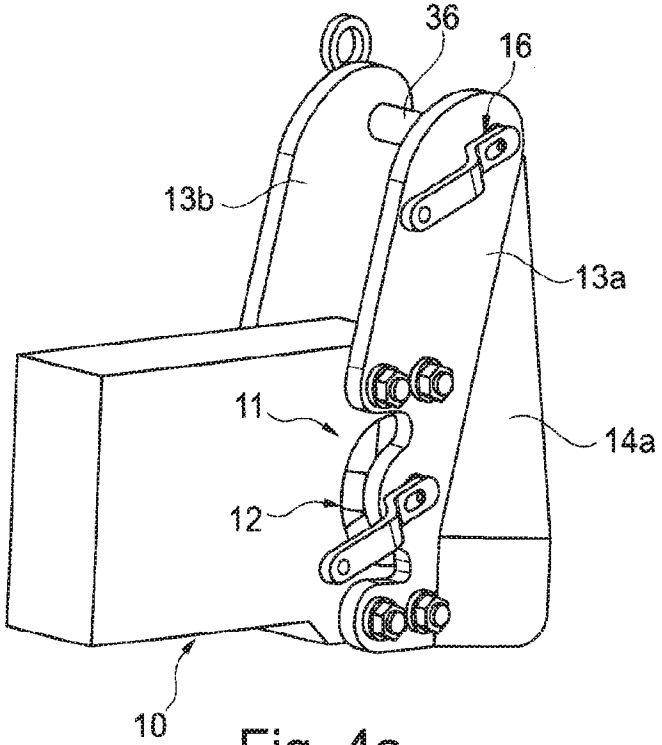

An embodiment of the invention will be explained in more detail in the following. FIGS. 1 to 4 show different views of the innovative connection point of the crane in accordance with the invention, with FIGS. 1*a*, 1*b* showing perspective side views of the existing connection; FIG. 2 showing a sectional representation in a longitudinal direction through the existing connection; FIGS. 3*a*, 3*b* showing perspective side views of the second connection part; and FIGS. 4*a*, 4*b* show ng perspective representations of the first connection part. An individual connection point is shown in each case, but the total connection between the boom/counterboom and the crane tip takes place by a plurality of such connection points.

The first connection point 10 is a component of the crane tip or of a slewing platform provided at the crane tip and is shown separately in FIGS. 4*a*, 4*b*. It is configured in the form of a connection socket 11 whose inner wall 12 has a concave shape with a negative radius of curvature. Side metal sheets 13*a*, 13*b* are attached, in particular screwed to the connection part 10, on both sides of the first connection part 10 in the region of the connection socket 11 and are initially in parallel with one another, but are angled outwardly in the boom direction forming an introduction funnel. The angled regions 14*a*, 14*b* form introduction aids for the introduction of the complementary connection part 20 into the connection socket 11. The side metal sheets 13*a*, 13*b* additionally project beyond the upper edge of the first connection part 10 and each have a bore 16 for receiving a pin at their upper end whose purpose will be explained later.

The complementary second connection part 20, shown separately in FIGS. 3*a*, 3*b*, is formed by the connection head 21 that extends at the end face from the corresponding articulated connection region of the boom/counterboom in the direction of the crane tip. The connection head 21 comprises a convex counter-abutment surface 22 whose positive radius of curvature is dimensioned as slightly smaller than the radius of the abutment surface 12.

Once the connection head 22 has been introduced into the connection socket 12, both connection parts 10, 20 can be pivoted with respect to one another about a horizontal axis due to the mutually matched radii, which is in particular of advantage during the assembly procedure. The connection section is substantially force fit since the second connection part 20 or the boom/counterboom is drawn in the direction of the tower tip or into the connection socket 12 by a guying. Oppositely directed tensile forces are removed by the connection pin 35 that is inserted through corresponding bores 15 of the side metal sheets 13*a*, 13*b* and through a central bore 25 of the connection head 22 transversely to the longitudinal boom axis. The connection pin 35 thus also forms the pivot axis of the two connection parts 10, 20. There is a force ratio here of approximately 10:1 between compressive forces and tensile forces during crane operation so that the connection pin 35 can be dimensioned as considerably smaller due to the comparatively small tensile forces.

It is still noteworthy that the width of the connection socket 12 should be larger than the width of the connection head 22.

A metal sheet 30 extends perpendicularly upwardly on the upwardly disposed peripheral surface of the connection head 22 and has a large-dimensioned circular aperture 31. This aperture serves as a capturing eye 31 that inter alia serves the capture of the boom/counterboom during the crane assembly. If the boom/counterboom taken up by an auxiliary crane is brought into proximity with the crane tip at the start, a capturing pin 36 can be inserted as a capturing means through the capturing eye 31 and through the bores 16 of the side metal sheets 13*a*, 13*b*. The boom part/counterboom part thereby captured can thereby be aligned more simply in the final position with respect to the establishing of the connection, i.e. the connection head 22 is introduced into the connection socket with the assistance of the introduction aids 14*a*, 14*b*. Finally, the connection pin 35 is inserted and the boom guying is tensioned or the top flange lug is connected.

The diameter of the capturing pin 36 is dimensioned as considerably smaller than the diameter of the capturing eye 31, which considerably simplifies the capturing of the second connection part. The capturing eye, however, also takes over a securing function during the dismantling process to avoid an uncontrolled pivoting away of the boom or counterboom. The boom or counterboom is taken up by the auxiliary crane and the connection pin 35 is drawn during the dismantling process. A comparatively small movement of the boom or counterboom is hereby produced if it had not been exactly received at its center of gravity by the auxiliary crane. This pivot movement is, however, bounded by the still inserted capturing pin 36 that abuts the inner wall of the capturing eye 31. In the following step, the crane operator of the auxiliary crane has to align the boom or counterboom so much that the capturing pin 36 is suspended within the capturing eye, i.e. does not abut the inner margin. If this is the case, the taken up boom part/counterboom part is in equilibrium and an unwanted pivot movement can be precluded after the drawing of the capturing pin 36. The boom or counterboom can then be let down by the auxiliary crane without risk.

Figure 5:
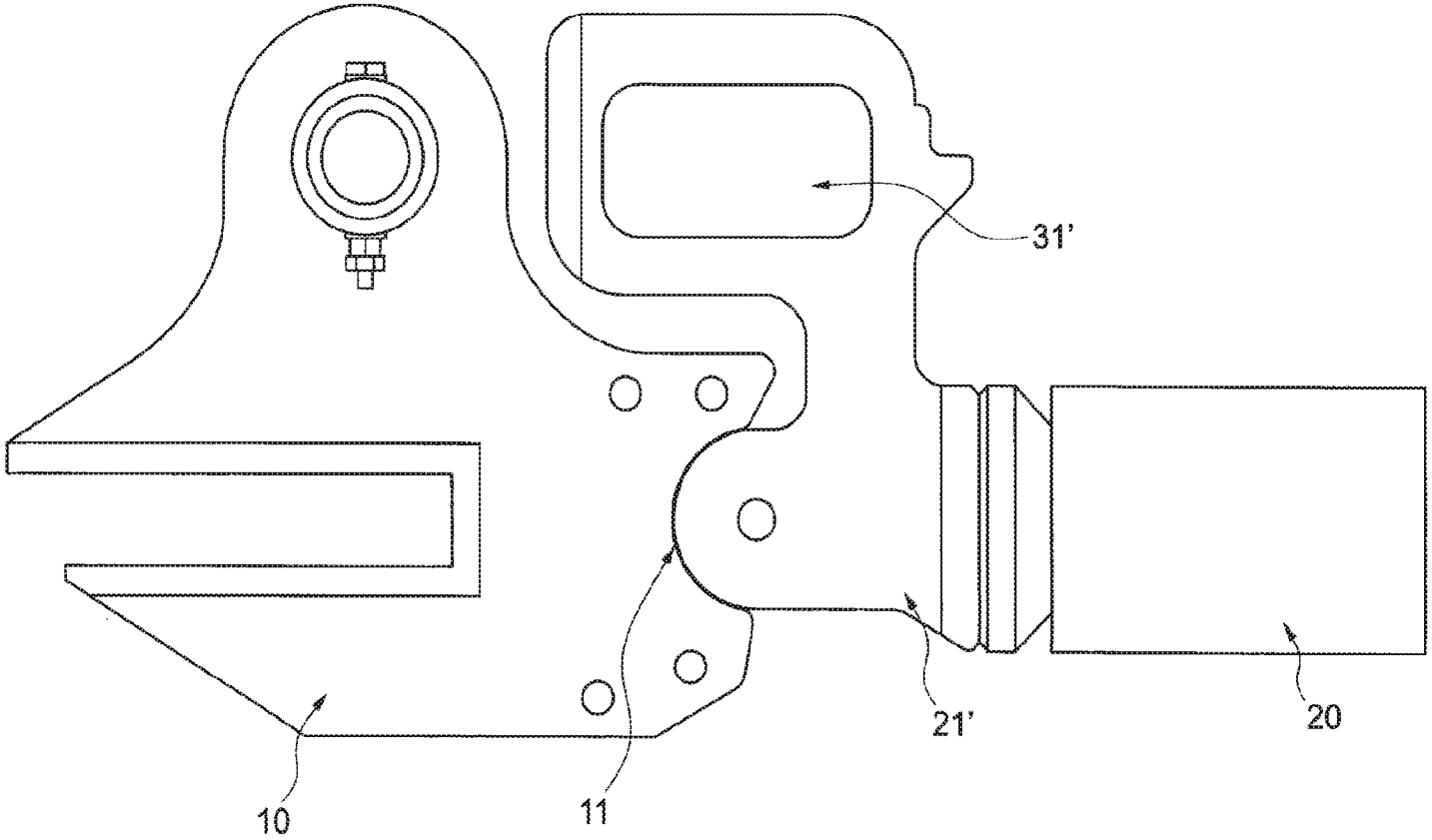
FIG. 5: a slightly modified embodiment of the connection point in accordance with the invention.

A slightly modified embodiment of the connection point in accordance with the invention can be seen from FIG. 5. This embodiment differs with respect to the features key to the invention in the embodiment of the connection part 20. The connection head 21' and the capturing eye 31' are formed in one piece here. The capturing eye 31' also does not have a circular aperture, but rather has an oval or rectangular aperture having rounded corners.

Figure 6:
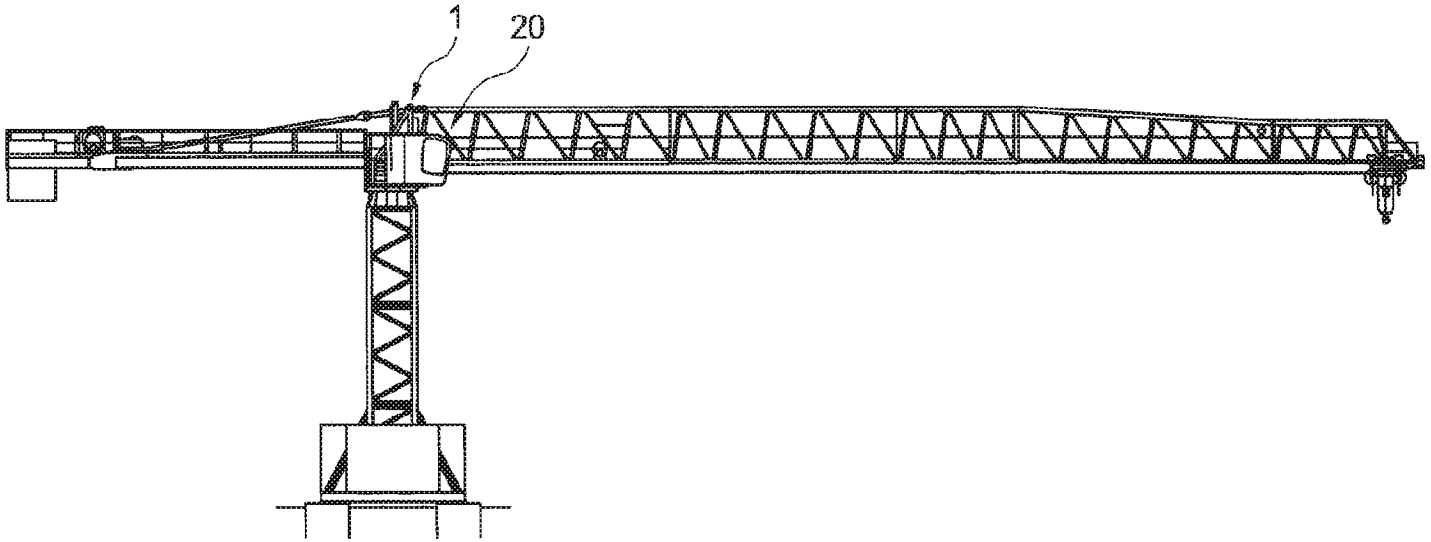
FIG. 6: an overall view of a crane with an assembled boom/counterboom.
Figure 7:
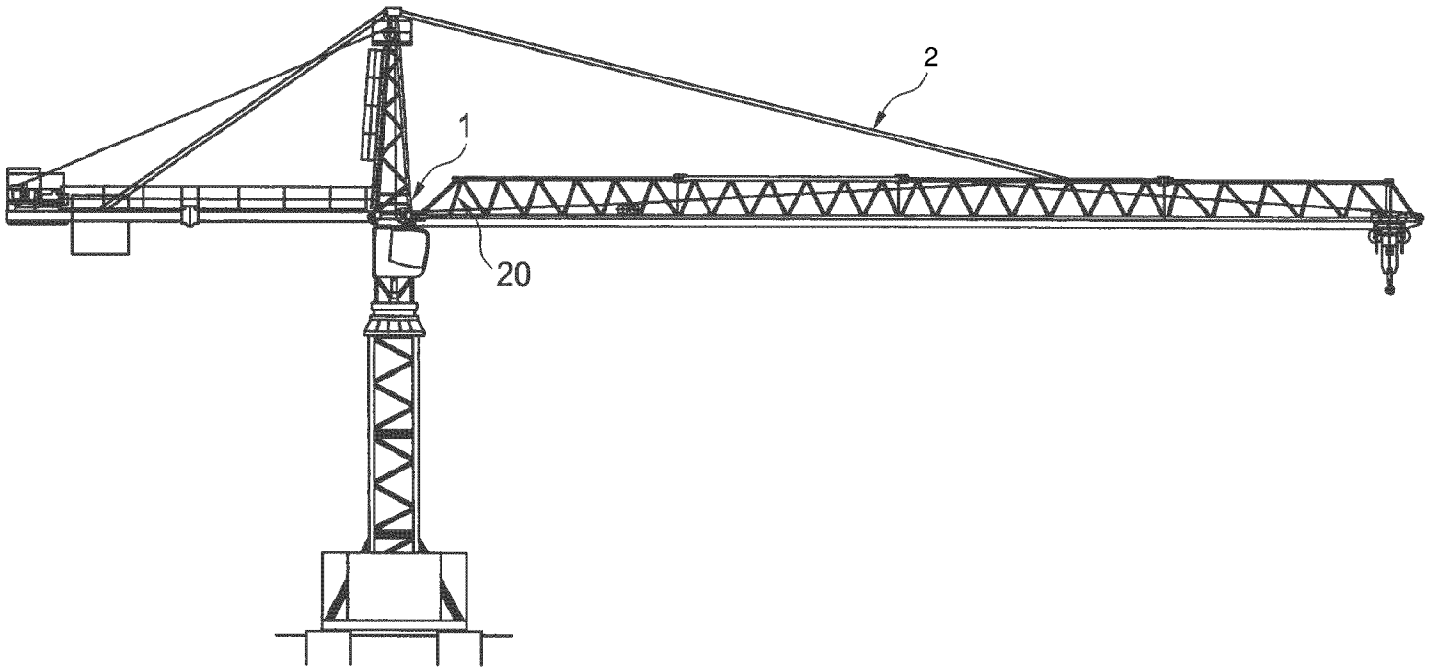
FIG. 7: a further view of a crane with an assembled boom/counterboom.

FIGS. 6, 7 respectively show an overall view of a tower crane whose boom 20 is assembled in the region 1 by means of the connection point in accordance with the invention at the crane tip or a slewing platform provided there. The force fit connection closure is achieved in the crane of FIG. 7 since the second connection part 20 (boom/counterboom) is drawn in the direction of the tower tip or into the connection socket 12 by the guying 2. In the crane type of FIG. 6, this force is generated by the load torque of the boom/counterboom.

The invention claimed is:

1. A tower crane, having a boom and a counterboom, wherein at least one of the boom and counterboom is connected in an articulated manner to at least one of a tower tip and a slewing platform by at least one connection point, a first connection part of the at least one connection point has a concave abutment surface and a second connection part of the connection point comprises a convex counter-abutment surface, with the counter-abutment surface of the second connection part acting by compressive force on the abutment surface of the first connection part, the second connection part comprises a connection head having a defined radius as the counter-abutment surface, the first connection part is configured as a connection socket having an inner radius adapted to the radius of the connection head as the abutment surface, and said concave abutment surface and convex counter-abutment surface are configured to contact one another and fit and be secured together by movement of said second connection part only along a common axis orthogonal to a vertical direction, wherein said head of said second connection part extends from an end face thereof having said convex counter-abutment surface with a positive radius of curvature dimensioned smaller than a negative radius of curvature of said concave abutment surface of said first connection part.

2. A tower crane in accordance with claim 1, wherein the compressive force is produced by at least one boom guying and/or by a load torque.

3. A tower crane in accordance with claim 1, wherein at least one connection pin is insertable transversely to a longitudinal beam axis, for fixing the connection with corresponding pin slots provided both at the first and second connection parts.

4. A tower crane in accordance with claim 3, wherein said pin slot for the connection pin at the second connection part is formed by a bore at a center of the radius of the connection head.

5. A tower crane in accordance with claim 1, wherein the at least one connection point is arranged directly at the tower tip or at a slewing platform provided in the region of the tower tip.

6. A tower crane in accordance with claim 1, wherein the first connection part is a component of the tower tip or of the slewing platform and the second connection part is arranged at the boom or counterboom.

7. A tower crane in accordance with claim 1, wherein at least one capturing eye is provided above the abutment surface or counter-abutment surface at the second or first connection part in assembly position, through which capturing eye a capturing pin extends, with the capturing eye being dimensioned larger than periphery of the capturing pin.

8. A tower crane in accordance with claim 7, wherein the capturing eye is formed by an aperture within a metal sheet that is perpendicular on the connection head.

9. A tower crane in accordance with claim 1, wherein one or more capturing metal sheets are provided in the region of the convex abutment surface that assist the leading together of the convex counter-abutment surface and the concave abutment surface during boom assembly.

10. A method of assembling a boom or counterboom at a tower crane, comprising the following steps:

providing the tower crane of claim 1;

moving the boom or counterboom into the region of the tower tip and capturing the boom/counterboom by leading capturing means through a capturing eye; and adjusting the boom or counterboom to lead the abutment surface and counter-abutment surface together and inserting a pin through the second connection part.

11. A method in accordance with claim 10, wherein a boom guying is tensioned or load torque is produced by lowering the boom after the insertion of the pin to apply compressive force to the connection point.

12. A method of dismantling a boom or counterboom at a tower crane comprising the following steps:

providing the tower crane of claim 1;

drawing a pin inserted through the second connection part;

aligning the boom/counterboom such that capturing means are freely suspended within a capturing eye; and pulling out the capturing means.

13. The crane of claim 1, wherein the compressive force is provided by guying said second connection part toward said first connection part.

14. A tower crane, having a boom and a counterboom, wherein at least one of the boom and counterboom is connected in an articulated manner to at least one of a tower tip and a slewing platform by at least one connection point, a first connection part of the at least one connection point has a concave abutment surface and a second connection part of the connection point comprises a convex counter-abutment surface, with the counter-abutment surface of the second connection part acting by compressive force on the abutment surface of the first connection part, the second connection part comprises a connection head having a defined radius as a counter-abutment surface, the first connection part is configured as a connection socket having an inner radius adapted to the radius of the connection head as the abutment surface, said first connection part additionally comprises side metal sheets on opposite sides thereof, and said side metal sheets each having a bore for receiving a pin therethrough, being substantially parallel with one another, projecting beyond an upper edge of said first connection part, and comprising edge regions angled outwardly to form a receiving funnel for the second connection part.

15. The crane of claim 14, wherein said second connection part comprises a bore therethrough and extending transversely to a longitudinal boom axis, such that the pin extends through said bores of said second connection part and side metal sheets to form a pivot axis between said first and second connection parts.

16. The crane of claim 14, wherein said second connection part comprises a sheet extending upwardly therefrom and comprising an aperture, and additionally comprising a capturing pin for extending through said aperture and a second set of bores through said side metal sheets to capture said second connection part therebetween.

* * * * *